US007032770B2

(12) United States Patent
Finlay et al.

(10) Patent No.: US 7,032,770 B2
(45) Date of Patent: Apr. 25, 2006

(54) CONTAINER WITH STRUCTURAL RIBS

(75) Inventors: Patrick J. Finlay, New Fairfield, CT (US); Michael T. Payne, Danbury, CT (US); Michael J. Swindeman, Middletown, OH (US); Balakrishna Haridas, Mason, OH (US)

(73) Assignee: PepsiCo, Inc., Purchase, NY (US)

( * ) Notice: Subject to any disclaimer, the term of this patent is extended or adjusted under 35 U.S.C. 154(b) by 0 days.

(21) Appl. No.: 09/790,676

(22) Filed: Feb. 23, 2001

(65) Prior Publication Data

US 2001/0027978 A1 Oct. 11, 2001

Related U.S. Application Data

(60) Provisional application No. 60/215,754, filed on Jun. 30, 2000.

(51) Int. Cl.
*B65D 23/00* (2006.01)

(52) U.S. Cl. ..... 220/669; 220/674; 220/675

(58) Field of Classification Search ..... 220/669, 220/670–675
See application file for complete search history.

(56) References Cited

U.S. PATENT DOCUMENTS

| | | | | |
|---|---|---|---|---|
| 4,024,975 A | | 5/1977 | Uhlig | |
| 4,863,046 A | | 9/1989 | Collette et al. | |
| 4,912,048 A | * | 3/1990 | Smith et al. | 220/674 |
| 5,002,199 A | | 3/1991 | Frahm | |
| 5,005,716 A | | 4/1991 | Eberle | |
| 5,054,632 A | | 10/1991 | Alberghini et al. | |
| D322,562 S | | 12/1991 | Narsutis | |
| 5,101,990 A | | 4/1992 | Krishnakumar et al. | |
| 5,222,615 A | | 6/1993 | Ota et al. | |
| 5,238,129 A | | 8/1993 | Ota | |
| 5,279,433 A | * | 1/1994 | Krishnakumar et al. | 220/669 |
| 5,499,730 A | | 3/1996 | Harbour | |
| 5,598,941 A | | 2/1997 | Semersky et al. | |
| 5,704,504 A | | 1/1998 | Bueno | |
| 5,709,304 A | * | 1/1998 | Credle, Jr. | 220/720 |
| 5,746,339 A | | 5/1998 | Petre et al. | |
| 5,758,790 A | | 6/1998 | Ewing, Jr. | |
| 5,810,195 A | * | 9/1998 | Sim | 220/674 |
| 5,887,739 A | | 3/1999 | Prevot et al. | |
| 5,890,595 A | * | 4/1999 | Credle, Jr. | 220/675 |
| D414,112 S | | 9/1999 | Waggaman et al. | |
| 6,036,037 A | * | 3/2000 | Scheffer | 220/674 |

FOREIGN PATENT DOCUMENTS

| | | |
|---|---|---|
| EP | 0 446 352 | 9/1991 |
| EP | 0 839 731 | 5/1998 |
| FR | 1558992 | 12/1967 |
| GB | 2 161 133 | 1/1986 |

OTHER PUBLICATIONS

Drawing of a bottle, Sidel Co., Octeville, France, drafted Sep. 1998.

* cited by examiner

*Primary Examiner*—Stephen Castellano
(74) *Attorney, Agent, or Firm*—Lars S. Johnson; James D. Ryndak

(57) ABSTRACT

A container is formed of a shell having a top section, a bottom section and a central section connecting the top section and the bottom section. At least a majority region of the central section is provided with a plurality of structural ribs about its periphery. The ribs are discontinuous in a circumferential direction extending around the central section. This construction enables the container to withstand deformation due to internal or external pressures.

12 Claims, 6 Drawing Sheets

CONTAINER WITH STRUCTURAL RIBS

This application claims the benefit of Provisional Application No. 60/215,754 filed Jun. 30, 2000.

FIELD OF THE INVENTION

The present invention relates to containers with structural ribs to resist deformation due to internal or external forces. More particularly, the present invention relates to beverage containers, such as bottles, having non-continuous ribs formed in their peripheral surfaces to resist deformation due to internal or external pressures.

BACKGROUND OF THE INVENTION

Various containers are used to package liquids, such as pressurized (e.g., carbonated) and unpressurized beverages. A commonly-used container is a polyethylene terephthalate (PET) bottle, which has been manufactured in various shapes and sizes. PET bottles are popular because they are inexpensive, lightweight, impervious to many gases and liquids and can be readily shaped into various designs and sizes. However, unlike containers formed of more rigid materials such as glass, PET containers can readily deform at low internal or external pressures, especially when the containers are thin-walled.

Certain PET containers or bottles have been designed with continuous ribs in order to provide some rigidity. However, although these ribs may perform satisfactorily when subject to moderate external pressures, they can readily deform when subjected to internal pressures, such as from the carbonation in certain beverages (50–100 psi). For example, certain containers for bottled water are provided with continuous ribs at the label panel area. Although the bottles are formed of relatively thin PET to lighten their weight, the continuous ribs add structural support at the area to be grasped by the consumer. That is, even though the containers are thin-walled, the pressure exerted by a consumer's grasping will not deform the containers because of the reinforcement provided by the continuous ribs. However, in some instances these water bottles are pressurized, such as by the addition of liquid nitrogen (up to about 40 psi), in order to survive distribution. It has been found, however, that this internal pressure tends to deform the continuous ribs over time. In some instances, the bottles would deform so as to "wash out" the continuous ribs. Improvements of this design have been attempted, such as by providing the continuous ribs with fillet radii. These modifications have achieved moderate success, but have not satisfactorily prevented deformation due to internal pressure.

Discontinuous ribs have also been proposed for plastic bottles for certain applications. U.S. Pat. No. 6,036,037 describes a plastic bottle that includes vacuum panels and reinforced bands above and below the vacuum panels. This particular bottle is for use in a "hot fill" application in which liquids are stored and sealed in the container while hot to provide adequate sterilization. The containers are typically filled under slight positive pressure and at temperatures approaching the boiling point of water when capped. However, cooling of the liquid product in the bottle usually creates negative internal pressure, which can partially collapse the bottle. Accordingly, the bottles are provided with six circumferentially spaced apart vacuum panels 3 in a central area to be covered by a label. When the volume of the hot product inside of the bottle shrinks during cooling, the faces of the vacuum panels are drawn inwardly to compensate for the reduction in pressure and prevent deformation of the other parts of the bottle. In addition, cylindrical bands 6 are disposed above and below the region of the vacuum panels 3. These bands 6 are formed of one or two circumferential hoop ribs 7, each made up of six recessed rib sections 8. These ribs provide hoop reinforcement to ensure completely cylindrical surfaces above and below the region of the vacuum panels, to which a label can be adhered. However, these circumferential hoop ribs are for compensating against negative internal pressure in conjunction with the vacuum panels and are not designed for providing against positive internal pressure.

SUMMARY OF THE INVENTION

It is, therefore, an object of the present invention to provide a lightweight container having acceptable sidewall rigidity.

It is further an object of the present invention to provide a container having acceptable sidewall rigidity and being able to withstand internal pressure without unacceptable deformation.

It is a further object to decrease the weight of a container without sacrificing container performance and customer acceptance.

It is yet another object of the present invention to provide a container having structural elements that can have an aesthetically pleasing appearance.

According to one aspect, the present invention relates to a container including a shell having a top section, a bottom section and a central section connecting the top section and the bottom section. At least a majority region of the central section is provided with a plurality of structural ribs about its periphery, the ribs being discontinuous in a circumferential direction extending around the central section.

According to another aspect, the present invention relates to a container including a shell having a top section, a bottom section and a central section connecting the top section and the bottom section. At least a majority region of the central section is provided with a plurality of structural ribs about its periphery, the ribs being discontinuous in a direction extending around the central section.

According to yet another aspect, the present invention relates to a container including a shell having a top section, a bottom section and a central section connecting the top section and said bottom section, and means for reinforcing the shell against external pressure and internal pressure.

DETAILED DESCRIPTION OF THE PREFERRED EMBODIMENTS

Figure 1:
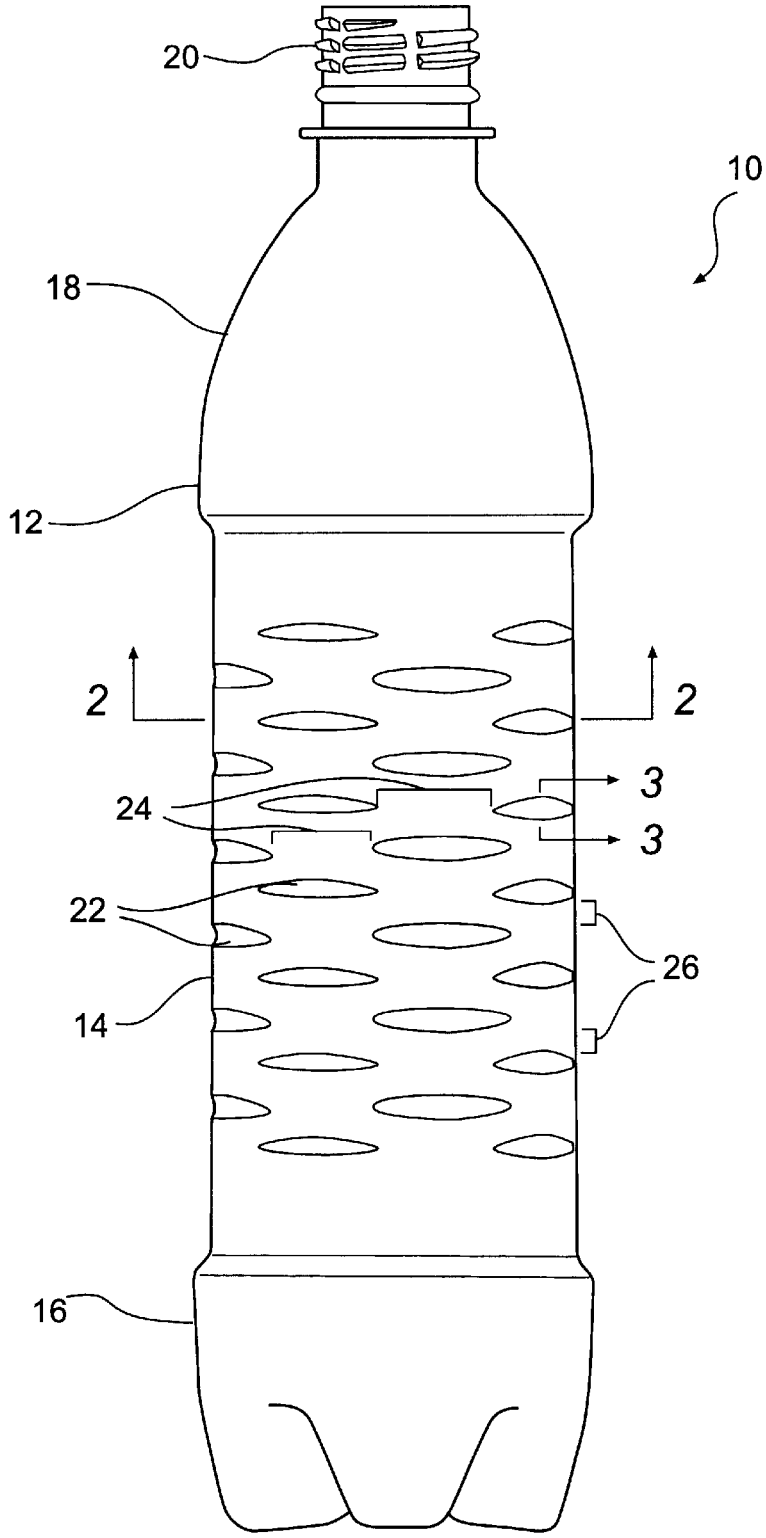
FIG. 1 is an elevational view of a first embodiment of a container according to the present invention.
Figure 2:
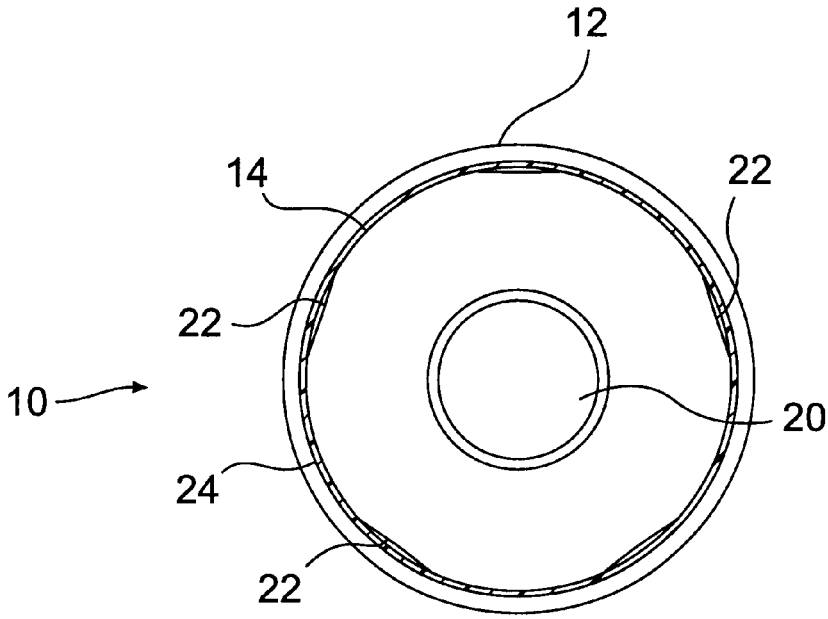
FIG. 2 is a cross-sectional view along section line 2—2 of FIG. 1.
Figure 3:
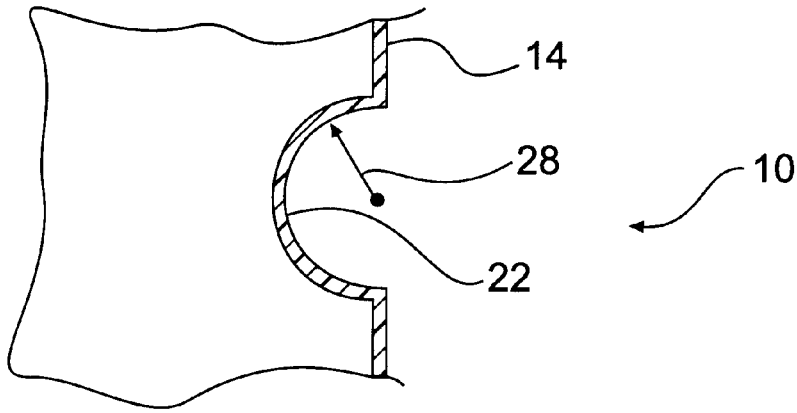
FIG. 3 is a cross-sectional view along section line 3—3 of FIG. 1.

A container according to a first embodiment of the present invention is shown in FIGS. 1–3. In this preferred embodiment, the container is in the form of a bottle 10 having an upper section 12 and a lower section 16, both connected by a central section 14. Upper section 12 includes a shoulder portion 18 and a neck 20. Neck 20 is threaded and is connected to shoulder portion 18. A cap (not shown) closes the neck 20 to seal the container 10.

Lower section 16 and upper section 12 have similar cross-sections, which are aligned vertically. In the depicted embodiment, central section 14 has a cross-section section of a lesser diameter than that of the upper and lower sections. However, the present invention is not limited to this embodiment and the upper, central and lower sections can have similar cross-sections.

Central section 14 is provided with a plurality of ribs 22 for structural support. In this embodiment, ribs 22 are in the form of axisymmetric indentations aligned in a plurality of rows throughout the central section. A horizontal land 24 is provided between each horizontally adjacent rib 22, such that the ribs are not continuous in the circumferential direction around the central section. In addition, vertical lands 26 are provided between each row of ribs. Although the ribbed region of central section 14 is most effective when it covers the entirety of the periphery of central section 14 as shown in FIG. 1, the present invention is not limited to this. A container having a ribbed region that covers the majority of the periphery of central section 14 can perform satisfactorily.

As shown in FIG. 2, each rib 22 projects internally toward the central axis of the bottle in a manner that it varies in depth. That is, the depth of each rib 22 smoothly increases from each end in the horizontal direction to a maximum depth in the middle. With this structure, stress carried by the rib can be spread out throughout its length. Additionally, the blend radius 28 of each rib 22, that is, the curvature of the rib in the vertical direction, is smooth and preferably circular as shown in FIG. 3.

Depending on the height of central region 14 of container 10 and depending on the applications for which the container is intended, the number of rows of ribs and the number and shape of the ribs vary. In the first embodiment, when used with a 0.5 liter bottle, 13 rows of ribs are provided, with 5 ribs in each row. Each rib is about 1.2 in. long and has a maximum depth of 0.04 in. Preferably, the ribs in one row are not aligned vertically with ribs in adjacent rows. As shown in FIG. 1, ribs in every alternate row are aligned vertically. This staggered arrangement improves the structure of the container by insuring that at least one rib is always activated when the container is squeezed.

The container of the first embodiment provides both sufficient hoop stiffness or rigidity, that is, resistance to crushing by a side load, as well as sufficient resistance to deformation of the side wall due to internal pressure. For internal pressure, the fundamental design concept employed uses the idea that for a container under internal pressure, membrane (midplane) stresses develop in the walls, just like a balloon under pressure. In addition to these membrane stresses, there are also bending stresses that develop depending on the thickness of the shell. Thus, the total stress state due to internal pressure is a sum of the membrane (or midplane) as well as the bending stresses. The bending stresses usually influence the magnitude of the stress on the outside and inside surfaces of the container. In containers made from PET subject to internal pressure over long periods of time, it is critical that the midplane (or membrane) component of the stress state be minimized to eliminate creep rupture problems. This is incorporated in the rib design geometry and dimensions of this embodiment, wherein the parameters have been selected such that in a thin walled PET shell, midplane stresses are maintained below the yield strength of oriented and crystallized PET.

In addition, in this embodiment, because the hoop stiffness is sufficiently great, the thickness of the plastic forming the container can be reduced. In a typical PET bottle, the thickness of the plastic is approximately 0.012 in., but with the structure of the present invention the thickness of the plastic forming the bottle can be reduced to less than 0.010 in., at least in central section 14, and still maintain a comparable hoop stiffness. For example, in the graph of FIG. 4, with a conventional continuously-ribbed 0.50 liter bottle formed of 0.008 in. PET and having a nominal diameter of 2.3 in. in the central section, it has been found that the diameter of the bottle changes significantly (that is, its side wall is displaced) at relatively low external loads. By contrast, in a similarly dimensioned bottle provided with ribs according to the first embodiment, this diameter changes significantly less at much higher loads. The intermediate bands support the hoop stiffness in the rib section and help transmit axial stress from one row of ribs to the next.

It has been found with the structure according to the first embodiment, midplane and bending stresses are significantly reduced as compared with a conventional bottle with continuous ribs.

Figure 4:
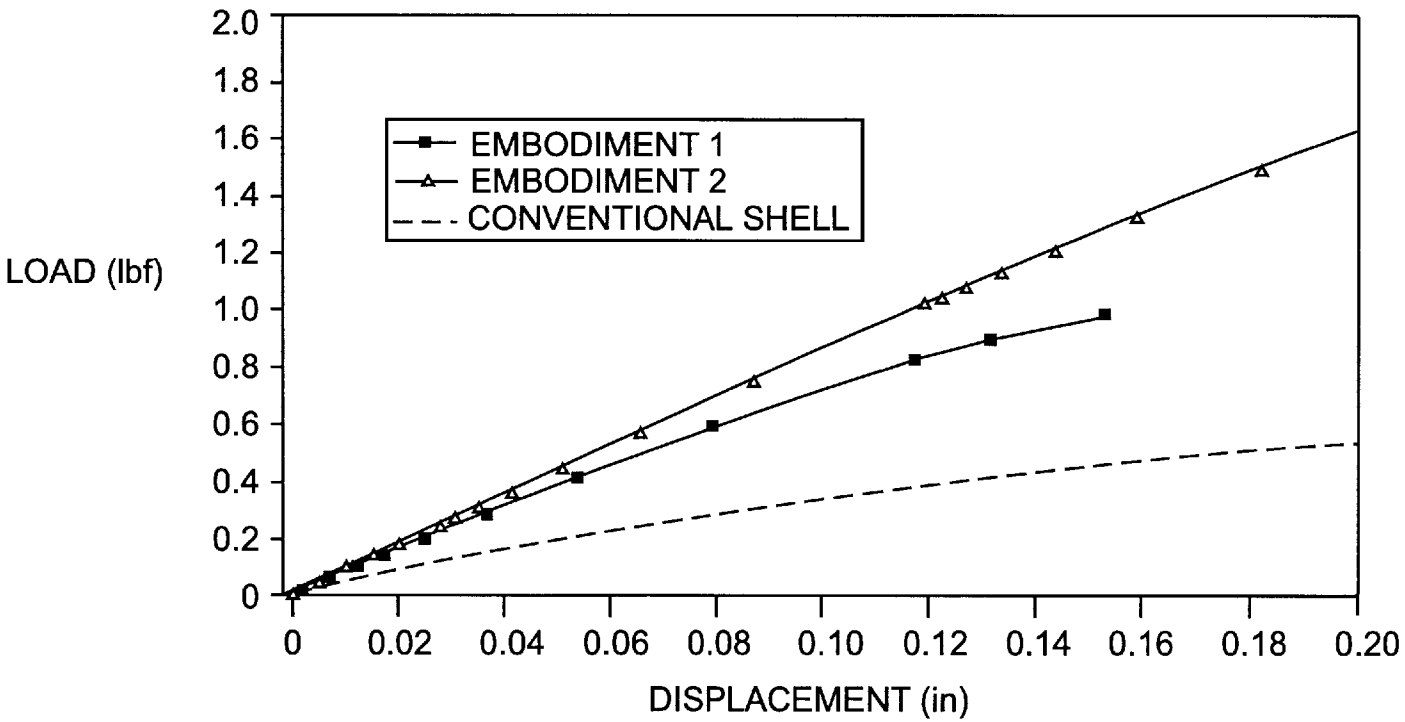
FIG. 4 is a graph comparing stiffness of containers according to the first and second embodiments with a conventional container.
Figure 5:
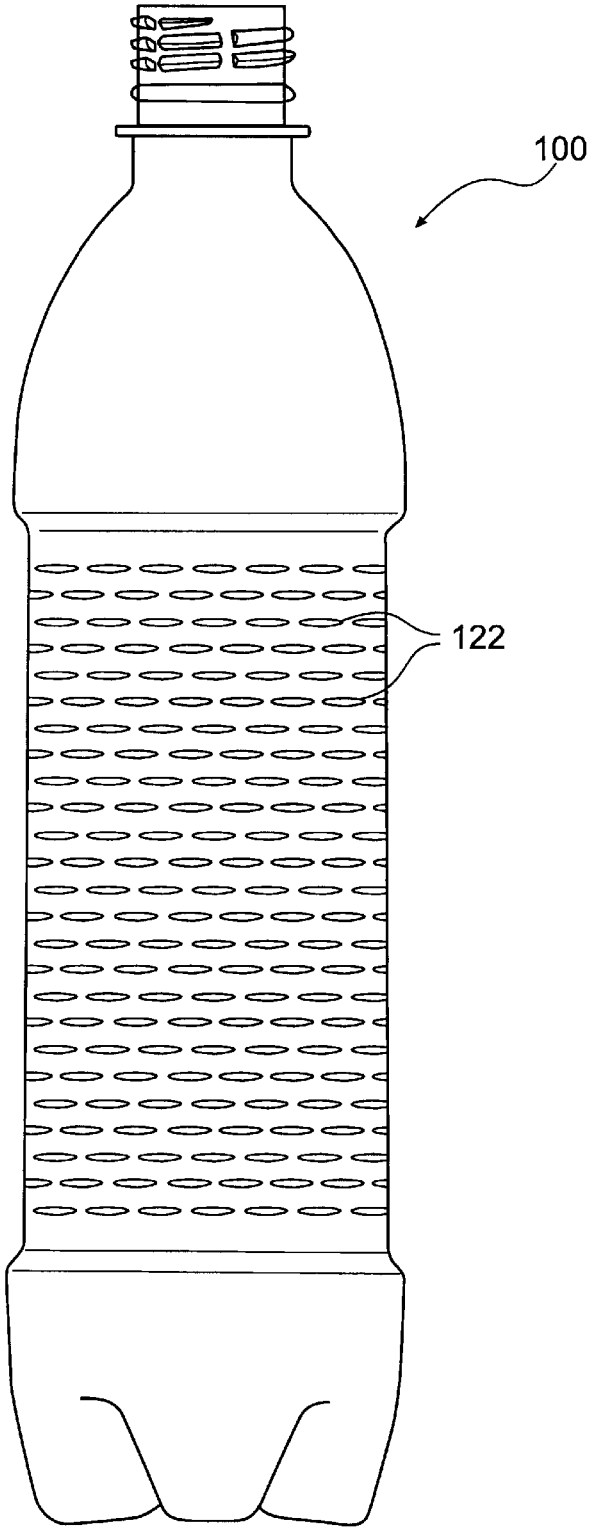
FIG. 5 is an elevational view of a container according to a second embodiment of the present invention.

The arrangement of the ribs is not limited to that shown in the first embodiment. For example, in the container 100 shown in FIG. 5, although the general shape of the ribs 122 is similar to that in the first embodiment, the size of the ribs is decreased, and the number of rows of ribs and ribs per row is increased. For example, for a 0.5 liter PET bottle, 25 rows of ribs with 16 ribs per row are provided. Each rib has a length of about 0.5 in. and a maximum depth of 0.04 in. As shown in the graph of FIG. 4, with the second embodiment the stiffness of the container is even more improved.

The number, size and shape of the ribs can be modified to achieve the desired axial stiffness and external and internal pressure resistance. Depending on the intended application of a container being designed, the arrangement of the ribs can be designed accordingly.

Figure 6:
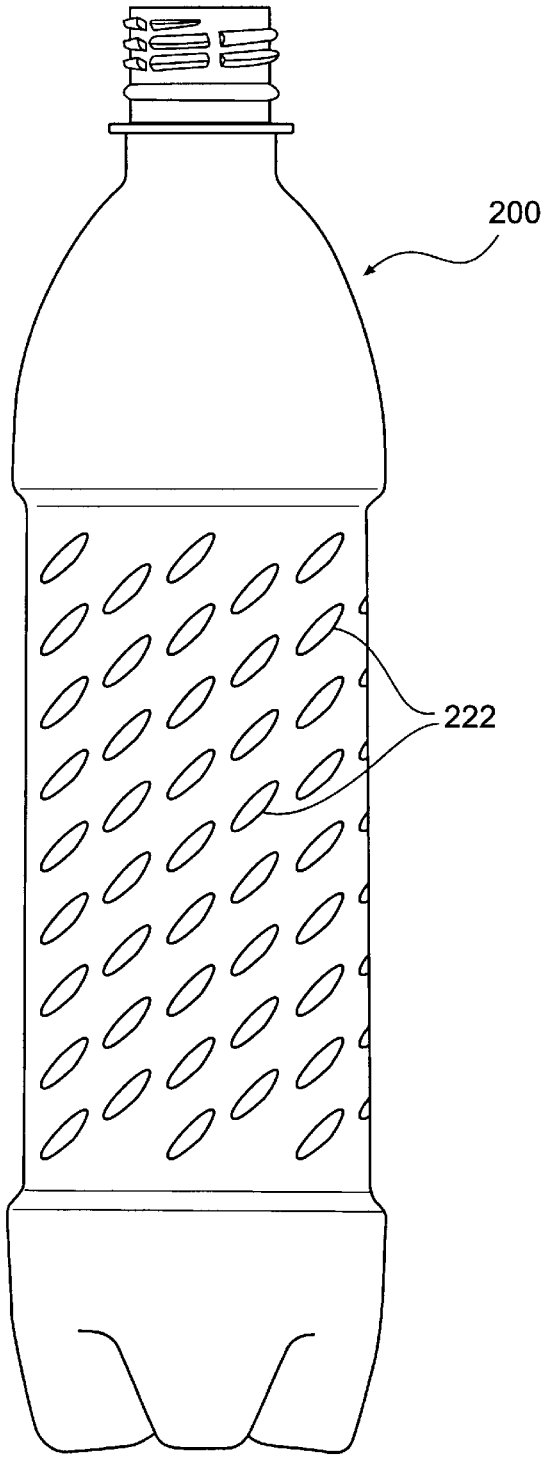
FIG. 6 is an elevational view of a container according to a third embodiment of the present invention.

The orientation of the ribs is also not limited to that shown in the first and second embodiments. That is, although the ribs are shown in the first and second embodiments to be parallel to the horizontal direction, they can be rotated up to 180°, relative to the horizontal direction and still achieve desired results. For example, in the container 200 shown in FIG. 6, the ribs 222 are rotated 45° relative to the horizontal. In this third embodiment, the ribs 222 need not be staggered in the vertical and horizontal directions to achieve the desired result.

Figure 7:
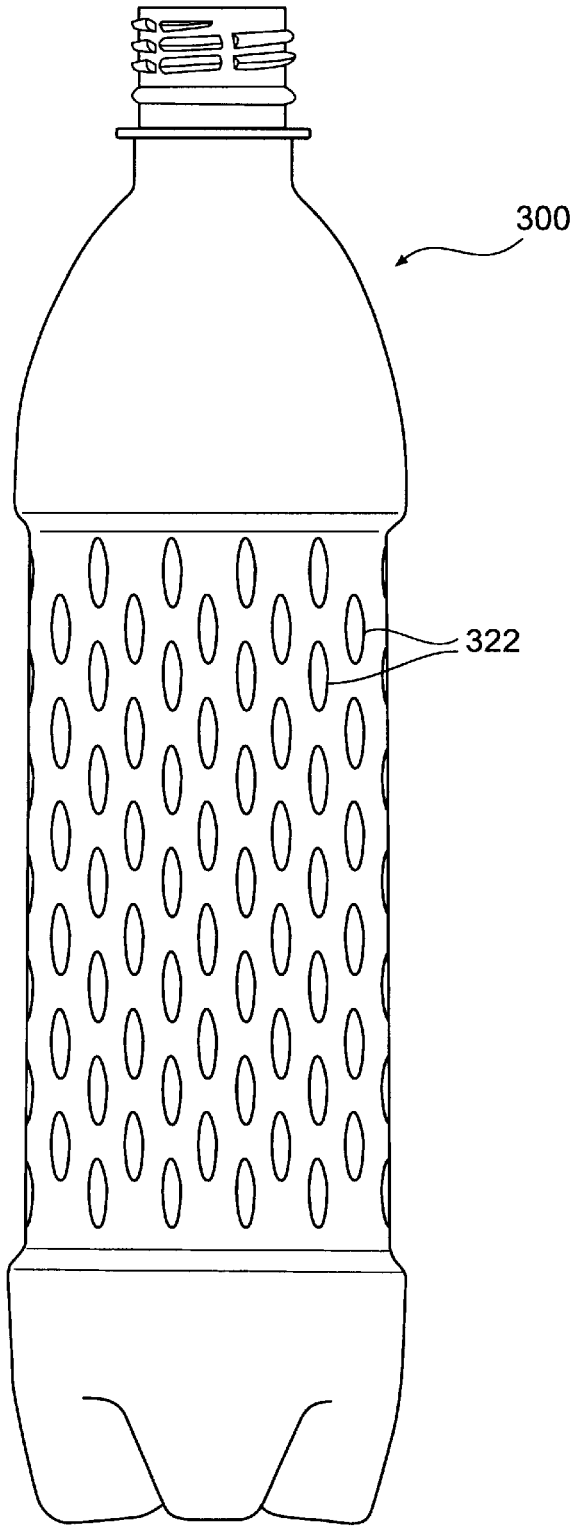
FIG. 7 is an elevational view of a container according to a fourth embodiment of the present invention.

In the container 300 of the fourth embodiment depicted in FIG. 7, the ribs 322 are rotated 90° relative to the horizontal such that they are disposed vertically. In this embodiment, alternate rows of ribs 322 are staggered as in the first and second embodiments.

As described above, the containers are preferably formed of PET, but can be formed of other materials including high- and low-density polyethylene, polypropylene and polyvinyl chloride, for example. PET containers are typically blow-molded. The blow-molding process is well-known to those in the art and it is considered unnecessary herein to explain the process in which a preform is blow-molded in a conventional manner.

While the present invention has been described as to what is currently considered to be the preferred embodiments, it is to be understood that the invention is not limited to them. To the contrary, the invention is intended to cover various modifications and equivalent arrangements within the spirit and scope of the appended claims. The scope of the following claims is to be accorded the broadest interpretation so as to encompass all such modifications and equivalent structures and functions.

What is claimed is:

1. A container comprising:

a shell having a top section including a shoulder, a lower section and a central section having a ribbed region and connecting said shoulder and said lower section, said lower section having a height substantially shorter than the height of said central section, wherein substantially all of said central section has the ribbed region disposed thereon, the ribbed region being provided with a plurality of structural ribs distributed about the periphery, of said central section, said ribs being discontinuous in a circumferential direction extending around said ribbed region and said ribs reinforcing said central section against at least one of internal and external pressures, wherein said ribs are elongated and of the same shape, each of said ribs having a depth that smoothly increases from each longitudinal end to a maximum depth in its longitudinal middle; wherein the curvature of each rib in the vertical direction is smooth and substantially semi-circular in shape wherein all of said ribs have substantially the same longitudinal angle of orientation relative to the vertical axis, with the longitudinal angle of orientation being linear and transverse to the vertical axis, and wherein the ribs are aligned in a plurality of rows that are disposed at the same longitudinal angle of oreintation relative to the vertical axis, ribs in one row are not being aligned vertically with ribs in an adjacent row.

2. A container according to claim 1, wherein ribs in each of said plurality of rows are aligned vertically with ribs in each alternate row of said plurality of rows.

3. A container according to claim 1, wherein each of said rows comprise 5 to 16 ribs.

4. A container according to claim 1, further comprising 13 to 25 of said rows.

5. A container according to claim 1, wherein said ribs comprise elongated indentations in said central section.

6. A container according to claim 1, wherein said shell is formed of PET.

7. A container according to claim 1, wherein said shell has a thickness of less than 0.010 in.

8. A container according to claim 1, wherein said shell has a capacity of about 0.5 liter.

9. A container according to claim 1, wherein said shell is blow-molded.

10. A container according to claim 1, wherein the ribbed region is disposed on the entirety of said central section.

11. A container according to claim 1, wherein said ribbed region is of a smooth surface in all areas other than areas where said ribs are positioned.

12. A container according to claim 1 wherein the central section has a cross-section that is of a lesser diameter than the cross-section of the lower section.

* * * * *